US007242785B2

(12) United States Patent
McNary

(10) Patent No.: US 7,242,785 B2
(45) Date of Patent: Jul. 10, 2007

(54) PORTABLE POWERED SPEAKER

(75) Inventor: Wade McNary, Miami Beach, FL (US)

(73) Assignee: Creative Technology Ltd, Singapore (SG)

( * ) Notice: Subject to any disclaimer, the term of this patent is extended or adjusted under 35 U.S.C. 154(b) by 476 days.

(21) Appl. No.: 10/909,979

(22) Filed: Aug. 3, 2004

(65) Prior Publication Data

US 2005/0031148 A1 Feb. 10, 2005

Related U.S. Application Data

(60) Provisional application No. 60/491,861, filed on Aug. 4, 2003.

(51) Int. Cl.
*H04R 25/00* (2006.01)

(52) U.S. Cl. ..... 381/182; 381/383; 381/345; 381/351; 381/300

(58) Field of Classification Search ..... 381/182, 381/374, 383, 389, 395, 345, 351, 300, 386; 181/148, 156, 196, 197, 198, 199
See application file for complete search history.

(56) References Cited

U.S. PATENT DOCUMENTS 4,042,778 A 8/1977 Clinton
4,596,305 A 6/1986 Jagborn
5,450,495 A 9/1995 Goldfarb
5,664,020 A 9/1997 Goldfarb et al.
5,864,100 A 1/1999 Newman
5,883,966 A 3/1999 Kubo
5,979,591 A 11/1999 Harrison
6,079,515 A 6/2000 Newman
6,176,346 B1 1/2001 Wiener
6,206,999 B1 3/2001 Ritto et al.
6,292,573 B1 9/2001 Zurek et al.
6,367,579 B1 4/2002 Wiener

*Primary Examiner*—Curtis Kuntz
*Assistant Examiner*—Tuan Duc Nguyen
(74) *Attorney, Agent, or Firm*—Russell N. Swerdon

(57) ABSTRACT

A portable speaker system includes a telescoping enclosure containing at least two drivers. The telescoping enclosure includes an inner section nested within an outer section. Each of the inner section and the outer section includes at least one speaker driver. The telescoping enclosure is configurable in at least two positions, a retracted or collapsed position and an extended position. By extending the telescoping enclosure, greater channel separation and greater internal volume for the enclosure is achieved.

20 Claims, 6 Drawing Sheets

Fig._2A
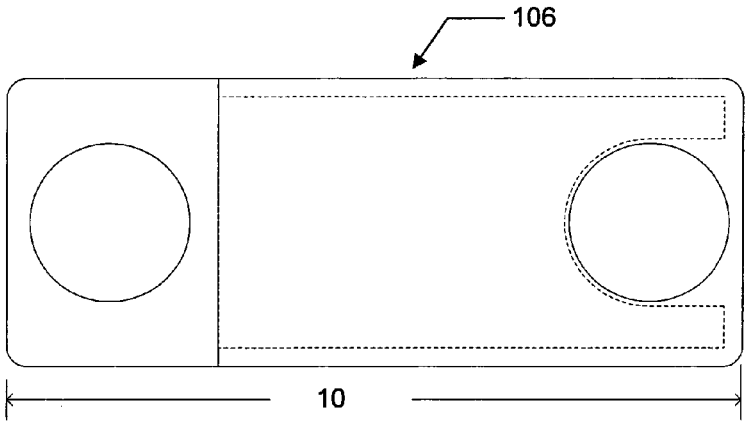
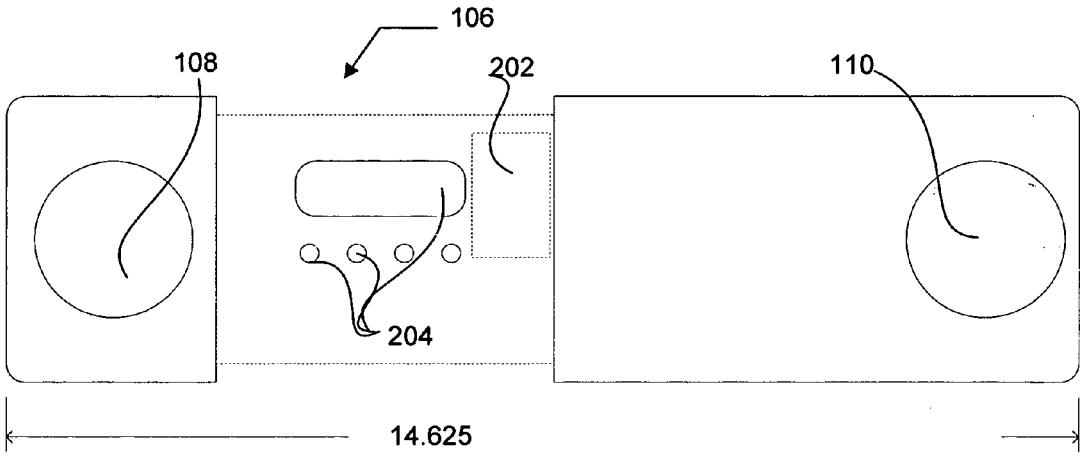
Fig._2C
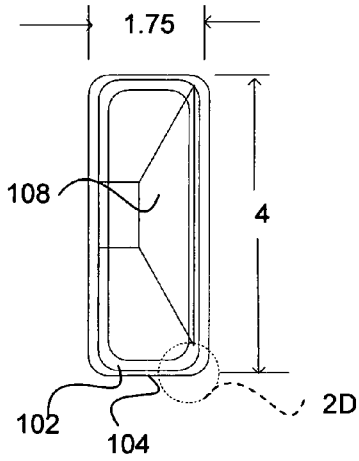
Fig._2B
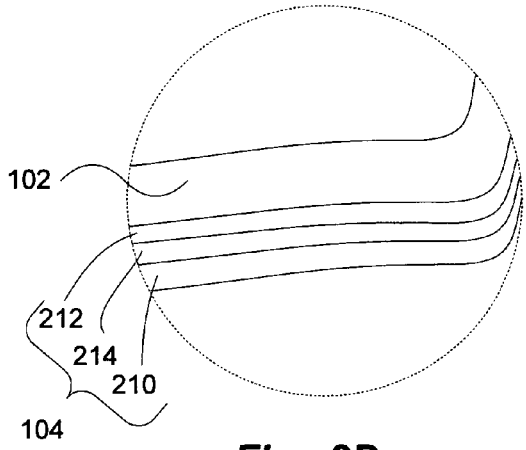
Fig._2D

PORTABLE POWERED SPEAKER

CROSS-REFERENCES TO RELATED APPLICATIONS

This application claims priority of provisional U.S. patent application Ser. No. 60/491,861, filed Aug. 4, 2003, titled "Portable Powered Speaker" the disclosure of which is incorporated by reference in its entirety.

BACKGROUND OF THE INVENTION

1. Field of the Invention

The present invention relates to portable speaker systems. More particularly, the present invention relates to portable speaker systems having adjustable enclosures.

2. Description of the Related Art

The portable audio market has changed dramatically in the past several years. Recent trends have focused on the improvement of overall sound quality of portable devices. Much of the improvement has occurred in the sources for sound generation. For example, portable CD audio players and MP3 audio players have garnered increasing shares of the portable market in comparison to more conventional cassette players and radio sources. While focus on such sources has helped the overall perceived sound quality, further improvements have been somewhat limited by portability constraints.

Portable audio products find wide usage in society. These audio products are often employed for work and personal use, e.g., at the office or home, as well as during travel in the car, in a park, garage, or hotel room, or even in business presentations using a laptop computer. The required portability of these audio devices limits the overall size and weight of the system and hence the types and sizes of the speaker drivers and enclosures used. Some conventional portable audio products include self-contained units such as portable radios and boomboxes to address the portability needs whereas others employ headphones, built-in laptop computer speakers, and miniature amplified speakers to accommodate portability in sound producing means.

Generally, it is desirable from a sound fidelity standpoint to user larger speakers. Larger speakers will achieve lower frequencies and therefore sound better than smaller speakers, but are bulkier and heavier which is a disadvantage for portability. Generally smaller speakers, either built-in to another device or stand-alone, in a single enclosure, are more easily transported, but cannot produce low frequencies, or achieve good stereo separation because of the short distance between the drivers. Therefore there is a trade-off between portability and sound quality.

It is therefore desirable to provide a portable speaker system having the sound quality obtainable from a larger enclosure but provided in an enclosure having a convenient size and shape for transporting.

SUMMARY OF THE INVENTION

The present invention provides a portable speaker system for use with portable electronic devices. The portable speaker system includes a telescoping enclosure containing at least two drivers. The telescoping enclosure includes an inner section nested within an outer section. Each of the inner section and the outer section includes at least one speaker driver. The telescoping enclosure is configurable in at least two positions, a retracted or collapsed position and an extended position. By extending the telescoping enclosure, greater channel separation and greater volume for the enclosure is achieved.

According to one embodiment, a portable speaker system is provided. The speaker system includes a telescoping enclosure having an inner section configured to nest within an outer section. The telescoping enclosure is configured to telescope along a longitudinal axis of the enclosure. A first driver is mounted or coupled to the inner section of the enclosure whereas a second driver is mounted or coupled to the outer section of the telescoping enclosure. The drivers are oriented such that their primary sound generation direction is directed perpendicular to the longitudinal axis of the telescoping enclosure.

These and other features and advantages of the present invention are described below with reference to the drawings.

BRIEF DESCRIPTION OF THE DRAWINGS

FIG. 2A is a front elevation view illustrating the portable speaker system of FIG. 1 in accordance with one embodiment of the present invention.

FIG. 2B is a side elevation view illustrating the portable speaker system of FIG. 2A in accordance with one embodiment of the present invention.

FIG. 2C is a front elevation view illustrating the portable speaker system of FIG. 2A in an extended position in accordance with one embodiment of the present invention.

FIG. 2D is an expanded drawing illustrating the wall construction shown in FIG. 2B.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are in inches unless otherwise noted and are not intended to be limiting as to the scope of the invention but merely illustrative.

The portable speaker system in accordance with several embodiments includes a telescoping enclosure having an inner section configured to nest within an outer section. Preferably, the telescoping enclosure telescopes along a longitudinal axis of the enclosure. A first driver is mounted within the inner section and a second driver is mounted within the outer section. At least one of the drivers and preferably both of the drivers representing both stereo channels are oriented such that their primary sound generation direction (i.e., along a primary axis) is substantially perpendicular to the longitudinal axis. That is, the primary axis of at least one speaker driver is substantially perpendicular to the longitudinal axis of the telescoping enclosure. The telescoping enclosure is configurable in at least two positions, a retracted or collapsed position and an extended position. By extending the telescoping enclosure, greater channel separation and greater internal volume for the enclosure is achieved.

Figure 1A:
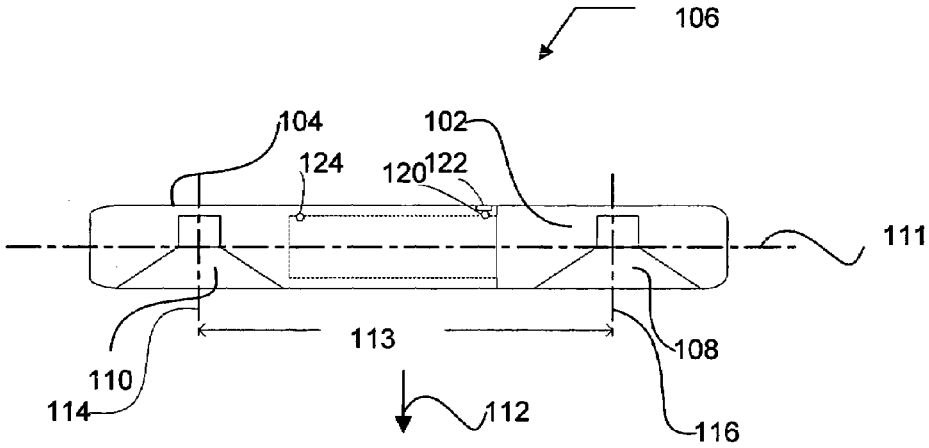
FIG. 1 is a plan view illustrating a portable speaker system in accordance with one embodiment of the present invention.

FIG. 1A is a plan view illustrating a portable speaker system in accordance with one embodiment of the present invention. A portable speaker system 106 is shown. The speaker system 106 includes an inner section 102 nested within an outer section 104 to form a telescoping enclosure 102, 104. Mounted within the inner section 102 is a first driver 108 and mounted within the outer section 104 is a second driver 110. The telescoping enclosure of the portable speaker system 106 is shown in FIG. 1A in a retracted or collapsed position. That is, the inner section 102 is closed or collapsed within the outer section 104 such that the size of the portable speaker system 106 is reduced. In this configuration, the separation distance 113 between the primary axes 114, 116 of the first and second drivers is reduced. Conversely, when the telescoping enclosure 102, 104 is extended, the separation distance 118 between the primary driver axes 114,116 is maximized for increased stereo channel separation as illustrated in FIG. 1B.

While not intending to be limiting, it is believed that the sound is improved by the expansion in at least two ways. First, in a preferred embodiment, the volume of the enclosure is substantially increased, preferably by approximately 60%. Second, by extending the enclosure, the enclosure provides increased separation of the left and right-channel drivers by an additional measure, preferably about 60%. Preferably, at least the first driver is oriented such that its primary direction of sound generation is in a direction 112 substantially perpendicular to the longitudinal axis 111. More preferably the second driver, corresponding to the second of two stereo channels, is also oriented such that the sound generation direction is substantially perpendicular to the longitudinal axis 111. In alternative embodiments, the first and second drivers are speakers oriented with their primary axes directed either perpendicular to the longitudinal axis or within a variation range from perpendicular wherein the channel separation provided by the telescoping enclosure may be appreciated. That is, even with the drivers oriented off of the perpendicular direction, their sound generation may be appreciated by a listener as being generally directed towards the listener. For example, in one embodiment, the first and second drivers may be configured such that the primary axes of each may be directed in a direction falling in the range from precisely perpendicular to about 45 degrees from perpendicular (either outward or inward, i.e., the primary axes intersecting in front of the speakers). More preferably, the range is limited to about 30 degrees or less from perpendicular. Preferably, the drivers are full frequency range drivers or ones covering most of the audible frequency range. As known in the art, directionality of audio signals is appreciated as the frequency extends above the low frequency range conventionally associated with subwoofers. In one embodiment, the drivers are capable of providing at least a frequency response as to at least all audible frequencies outside the low frequency range associated with subwoofers. In other embodiments, the drivers are capable of providing a full frequency response including the low frequency range associated with subwoofers. The foregoing is intended to be illustrative and not limiting as to the scope of the invention.

Figure 1B:
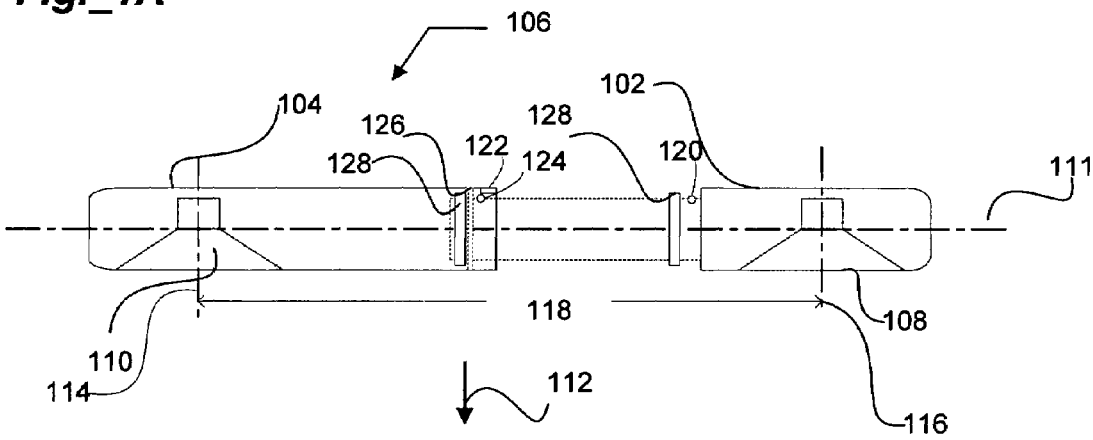

FIG. 1B is a plan view illustrating the portable speaker system of FIG. 1A in an extended position in accordance with one embodiment of the present invention. In specific, FIG. 1B illustrates the portable speaker system 106 in an extended position, extending along the longitudinal axis 111, for increased sound stage effects during use of the speaker system 106. In other words, the telescoping enclosure of the portable speaker system 106 retracts to reduce its size for transport as illustrated in FIG. 1A and extends, as illustrated in FIG. 1B, to increase its size in use, to generate improved sound. Preferably, the separation distance for the telescoping enclosure in the closed position increases by at least 2 inches when extended. More preferably, the separation distance increases by 4 to 6 inches or more when the enclosure is extended. Most preferably, the separation distance increases by at least 6 inches when the enclosure is extended. The increase in separation between the primary axes of the drivers in the extended position is a design consideration, preferably based at least in part on the size of the drivers, the frequency response desired, and the volume of the enclosure in the retracted and extended positions. Accordingly, the dimensions illustrated and described are intended to be illustrative only and not limiting as to the scope of the invention.

In one preferred embodiment, the inner and outer sections are configured with one or more detent mechanisms respectively located in at least one of the inner and outer sections to lock the enclosure in either or both of the extended (open) position and the retracted (closed) position. For example, as illustrated in FIG. 1B, a first detent mechanism 120 may be located on the inner section 102 to engage a catch 122 concealed in the outer mechanism. Suitable detent mechanisms such as ball detents or the like are known to those of skill in the relevant art and therefore further details will not be provided here. In order to lock the telescoping enclosure in the extended position, a second detent mechanism 124 may also be located on the inner section 102 of the enclosure 102,104, for example to engage the same catch 122. Optionally, the inner section 102 may be sealed against the outer section 104 through the use of an O-ring or similar sealing material. For example, an O-ring 126 may be located on the inner surface of the outer section 104 to sealingly engage with a corresponding annular surface 128, for example a protruding integral ring 128, located on the inner section 102. Methods of sealing nesting enclosures are known to those of skill in the art and therefore further details will not be provided here. By sealing the inner section 102 to the outer section 104 a sealed common enclosure is provided for the first and second drivers for improved sound reproduction quality.

FIG. 2A is a front elevation view illustrating the portable speaker system of FIG. 1 in accordance with one embodiment of the present invention. FIG. 2B is a side elevation view illustrating the portable speaker system of FIG. 2A in accordance with one embodiment of the present invention. FIG. 2C is a front elevation view illustrating the portable speaker system of FIG. 2A in an extended position in accordance with one embodiment of the present invention. The enclosure 102, 104 in a preferred embodiment forms a substantially flat configuration, as illustrated in FIG. 2B. A preferred range of the height to width in profile is 2 or more. This flat profile provides reduced size advantages for transporting the speaker system in a briefcase or other carrying container. Preferably, the inner section 102 of the telescoping enclosure 102, 104 of the speaker system 106 contains the amplification unit 202 for the portable speaker as well as the input/output devices 204, i.e., the device's inputs, outputs, controls, and displays. In this configuration, the controls and displays are exposed when the device is open for use and protected by the outer section 104 when the device is closed for transport.

FIG. 2D is an expanded drawing illustrating the wall construction shown in FIG. 2B. The telescoping enclosure 102, 104 is preferably constructed using multiple layers, such that sufficient rigidity is provide along with sound damping qualities. For example, in one preferred embodiment, each of the inner section and outer section of the enclosure is composed of a 3-layer wall construction for high rigidity and low weight. For a non-limiting example, the outer shell 210 may be formed from deep-drawn aluminum to provide protection and stiffness at a very low weight. The inner shell 212 is also preferably composed of a rigid material, such as a plastic. The middle layer 214 may be formed from any suitable damping material, for example rigid expanded polyethylene foam, to add rigidity and adhesion between the three layers along with the damping qualities. Although the 3-layer construction is shown only for the outer section 104, it is understood that the multilayer construction is preferably used also in the inner section 102.

In an alternative construction, the plastic inner shell 212 is constructed with ribs that, when adhered to the outer shell, form an air gap, or honeycomb wall. Between the two layers is a layer of rigid polyethylene foam that damps, stiffens, and adheres the inner and outer layers, forming a lightweight, rigid enclosure.

Preferably, the outer shell 210 of deep drawn aluminum is cross-punched with holes for the drivers to transmit sound. The inner layer, in one embodiment, contains the mounting features for the drivers and electronics, as well as the details and seals for the telescoping function. For example, in one embodiment, the inner layer is formed in an injection molding process. Suitable materials are expected to include a blend of ABS and polycarbonate plastics. Preferably, the plastic shell forming the inner section and the outer section are designed to produce varying foaming gaps such that the wall formed minimizes natural frequencies (resonant frequencies). Drivers are preferably mounted to the inner layer of the inner section by molded plastic posts. The printed circuit board containing the amplification circuit and other electronic circuits described is fastened in one embodiment to the plastic inner layer of the inner section, with input and output jacks and battery contacts properly positioned for their respective openings. Prior to assembly of the inner section and the inner section, the "halves" are stuffed with a damping material such as polyester fibers.

Figure 3A:
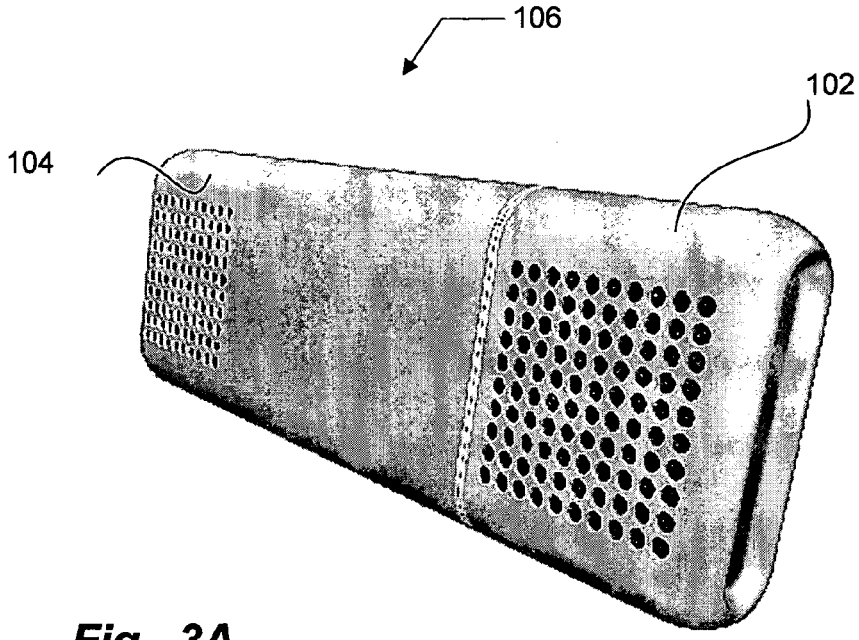
FIGS. 3A and 3B are perspective views illustrating a portable speaker system in accordance with one embodiment of the present invention.
Figure 3B:
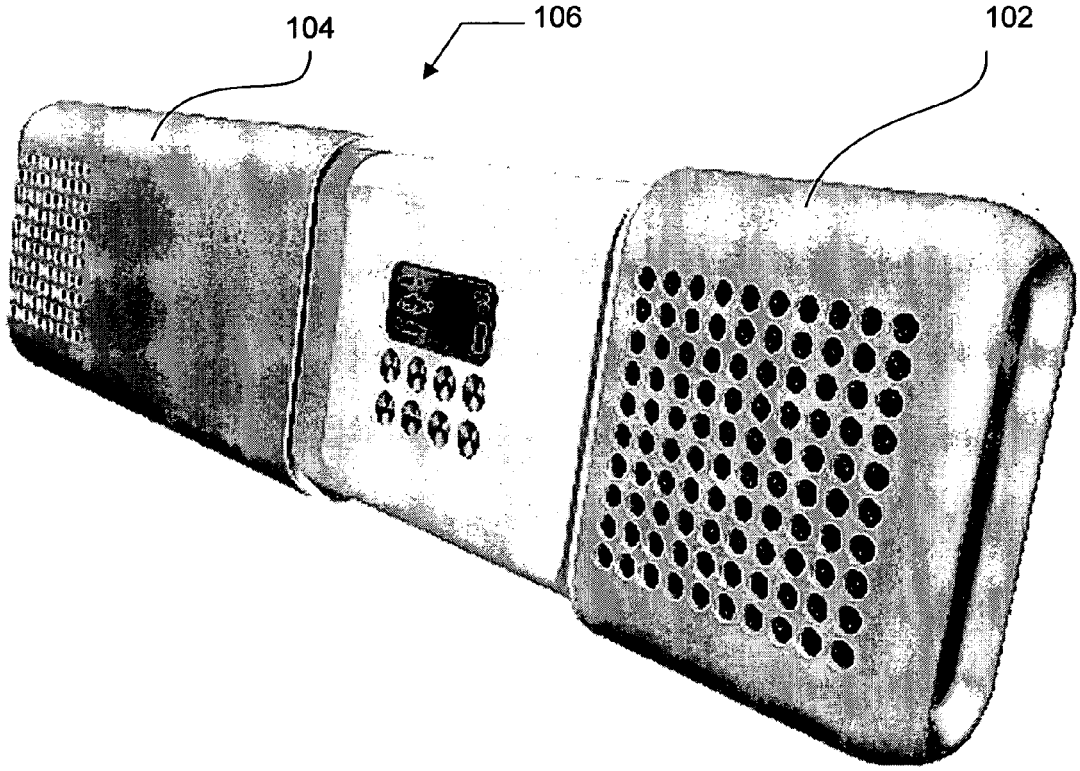
Figure 4A:
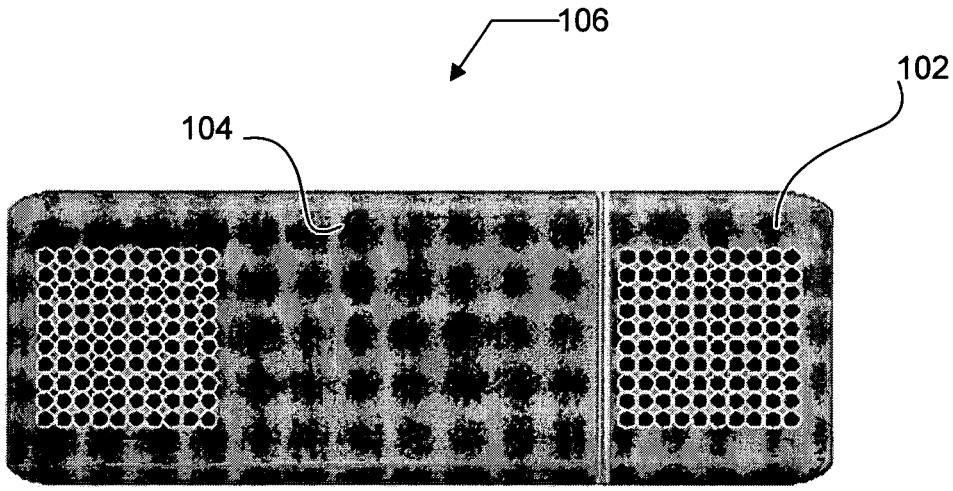
FIGS. 4A and 4B are perspective views illustrating a portable speaker system in accordance with one embodiment of the present invention.
Figure 4B:
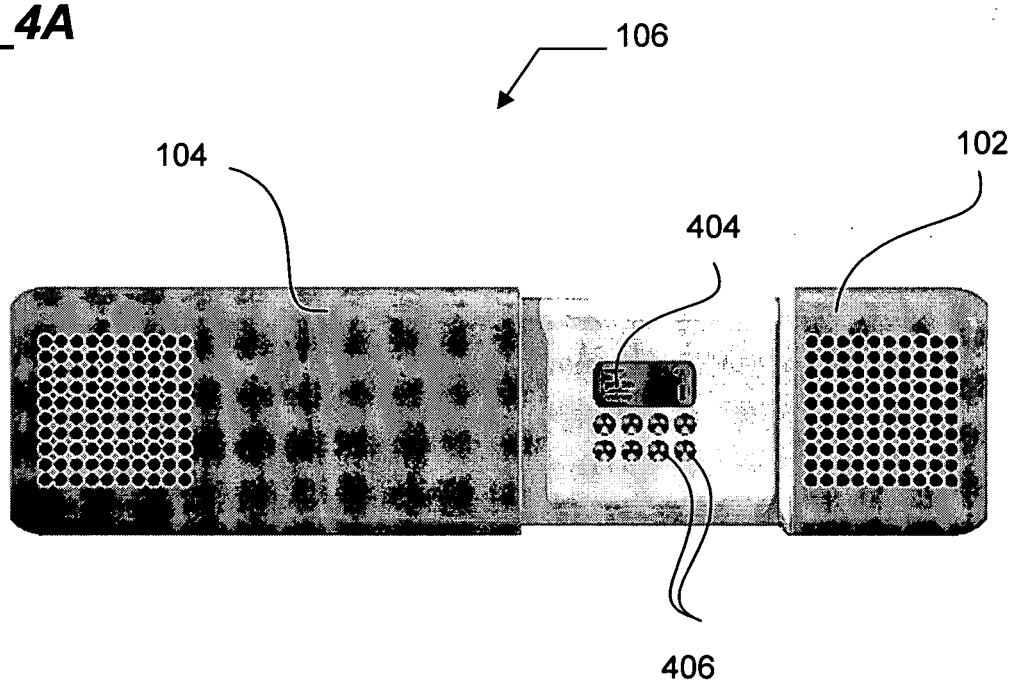

FIGS. 3A and 3B are perspective views illustrating a portable speaker system in accordance with one embodiment of the present invention. The telescoping enclosure of the portable speaker system 106 here is generally configured with a flat profile, for ease of transport and storage. For example, the relatively flat profile permits the portable speaker system to be easily carried in a brief case. FIGS. 4A and 4B are front views of the portable speaker system illustrated in FIGS. 3A and 3B. FIGS. 3A and 4A illustrate the speaker system in a collapsed position whereas FIGS. 3B and 4B illustrate the telescoping enclosure in an extended position. In particular, FIGS. 3B and 4B illustrate the inner section 102 having a display 404 and controls 406 for operation of the speaker system 106. That is, the inner section 102 preferably contains all the features for mounting the electrical components, as well as mechanisms and details to perform the telescoping function.

Figure 5A:
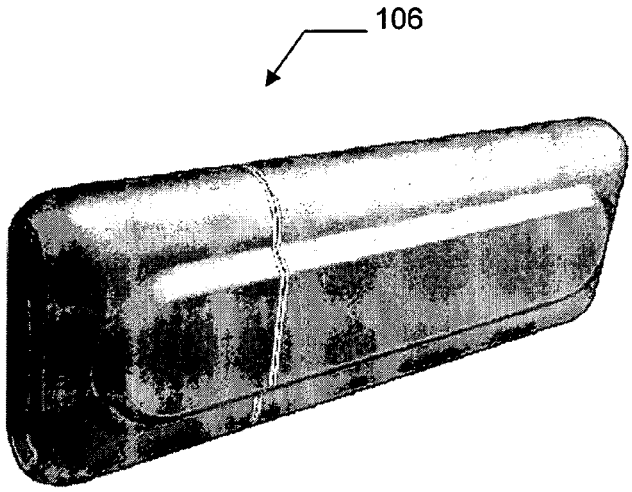
FIGS. 5A and 5B are perspective views illustrating a portable speaker system in accordance with one embodiment of the present invention.
Figure 5B:
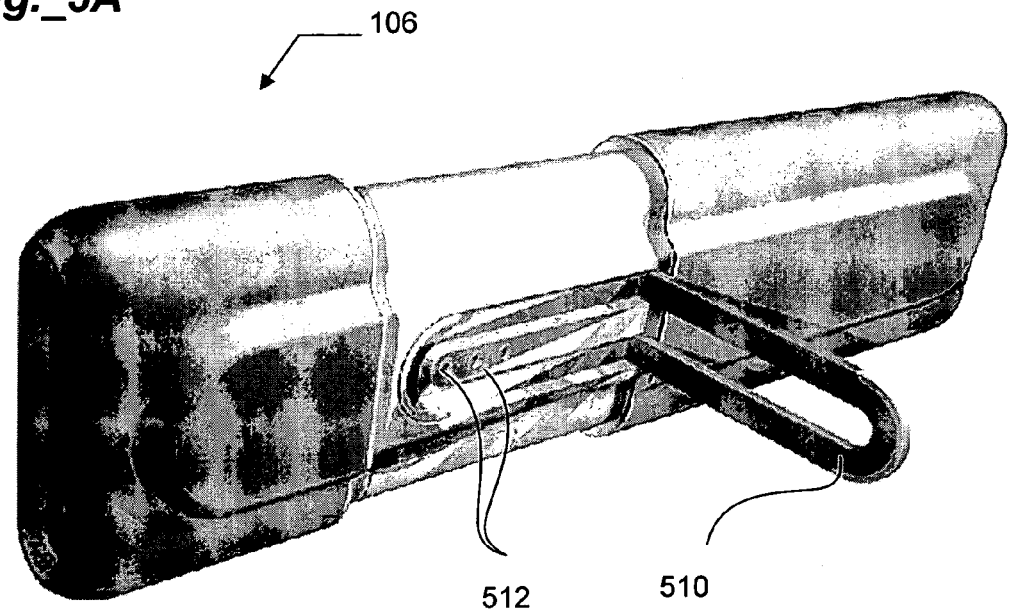
Figure 6A:
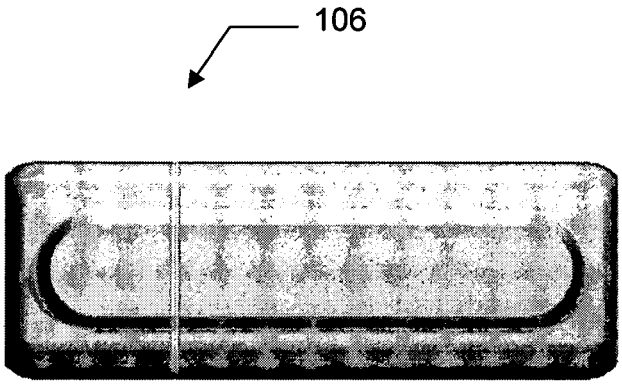
FIGS. 6A and 6B are perspective views illustrating a portable speaker system in accordance with one embodiment of the present invention.
Figure 6B:
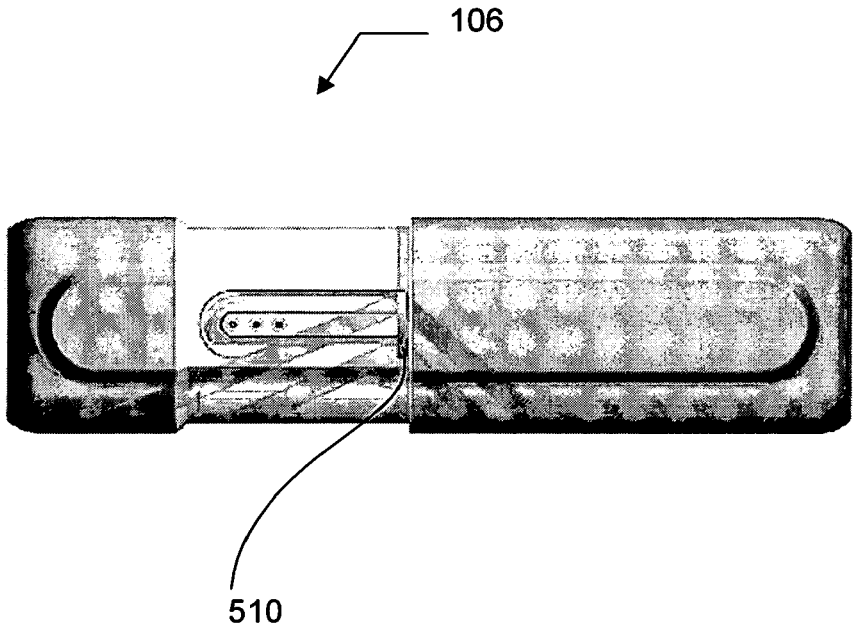

FIGS. 5A and 5B are perspective views illustrating a portable speaker system of in accordance with one embodiment of the present invention. FIGS. 6A and 6B are rear elevation views illustrating the portable speaker system illustrated in FIGS. 5A and 5B. FIGS. 5B and 6B illustrate the speaker system in an extended configuration with a support leg 510 extending from the rear of the speaker system 106 to support the system. The system automatically deploys a spring-loaded support leg when its enclosure is expanded. In one embodiment, the support leg is provided with a resilient pad (not shown) located on its distal end to provide a non-skid contact surface for the support leg. Preferably, the support leg is extended by a torsion spring located on the axis of the support leg hinge, with damping grease provided on the support leg to dampen the opening movement of the support leg when the telescoping enclosure is extended. Those of skill in the relevant art are familiar with details as to miniature springs and support legs and therefore further details will not be provided here.

The portable speaker system is preferably carried in its closed position. In operation, the user expands the audio device from its collapsed position by pulling the ends of the enclosure in opposing directions until the enclosure detents into its open position. Upon opening the device, in a preferred embodiment, a leg automatically pops out from the back of the inner shell, creating a third support point for the device to stand upright. When the user closes the speaker system, the leg automatically folds back into its retracted, stored position, preferably in a cavity or recess formed between the inner and outer shells. Alternatively, the recess may be formed entirely in the inner shell. In the extended configuration, with the rear support leg out, the portable speaker system may be positioned in a standing position, for example for placement on a table.

In the extended position, preferably each of the two drivers share the common enclosure. That is, no baffle or other barrier is provided in the common enclosure to separate the enclosure volume accessible from each of the two drivers. According to one specific embodiment, the speaker enclosure in the extended position provides at least 15 to 20 cubic inches of enclosure volume per driver. Preferably, the telescoping enclosure provides a common enclosure to serve both drivers. Although the size of the individual drivers can vary in accordance with design requirements, in one embodiment the diameter of the drivers are approximately 2 inches, and a corresponding depth of the speakers of about 1 inch, with the common enclosure (i.e., the telescoping enclosure in the extended position) having an internal volume of between 20 and 40 cubic inches. Thus, a relatively flat telescoping enclosure is provided.

The scope of the invention is further intended to extend to telescoping enclosures providing separate enclosure volumes for each of the two drivers (or channels when multiple drivers are provided). Although preferably the telescoping enclosure provides a sealed enclosure volume, the invention is not so limited. Bass reflex enclosures (i.e., ported enclosures) are used to extend the useful bass range of loudspeakers and the present invention is intended to embrace ported enclosure designs in alternative embodiments.

Preferably, the portable speaker system is configured to operate on both batteries and ac power or alternatively connected to an auxiliary power source, e.g., vehicle power source (12 vdc) using a car plug. In one embodiment, the speaker system contains an input port 512 to receive the input signal from an audio source, e.g., a CD player, MP3 player, laptop computer, portable video game, or anything with a headphone jack. In order to efficiently use battery power, the portable speaker system is configured to remain in a very low power sleep mode until it detects a signal from an audio source provided, for example, to input jacks 512 located on the inner section 102. Hence, when the device is disconnected from an audio source or the audio source is not playing, the speaker automatically returns to sleep mode to conserve batteries, or auxiliary power. This obviates the need for a power switch. When it detects the signal from an audio source, it preferably powers up its amplifier to drive the speakers, and stay powered for a short period after the source signal is removed, for example for a period approximating one minute. These functions are preferably provided by a processor located within the portable speaker system. In one specific design embodiment, the processor normally keeps the speaker system in a low-power sleep mode, and wakes up every 18 milliseconds to check the audio input connection for voltage. The checking of the input voltage is performed for just a few microseconds every 18 milliseconds or so. Hence, very little power is used in the idle state. When an audio source is plugged in and powered, a voltage appears at the system's input connection. When the processor detects this voltage, the processor powers up and powers up the system's amplifier. While powered up, the processor continues to check the input for voltage periodically, and if the voltage is present it remains powered up.

The portable speaker system in conjunction with its power saving circuitry may be adapted for use with electronic devices having clock functions to serve as an alarm clock. For example, some portable media players have built in clock functions that permit the player to be turned on at a preselected time. By plugging the media player into the portable speaker system, the portable speaker is converted into an audio alarm clock. In specific, the portable media player may be set to turn itself on at a specific time, resulting into an attached portable speaker system likewise turning on at the preselected time.

Preferably, a single portable speaker system 106 contains two drivers, and when plugged into a stereo audio source, plays the left and right audio channels. The scope of the invention is intended to extend to all portable speaker systems having at least two drivers. For example, the scope of the invention is intended to extend to portable units having 4 drivers, for example, two drivers for each channel.

The sound reproduction environment can be further augmented using the portable speaker system coupled with additional speakers to achieve greater stereo separation and/or bass response. For example, according to one embodiment, the portable speaker system also contains an output port that can be connected to a second portable speaker system. In this configuration, the first portable speaker system is preferably configured to detect the second portable speaker system and plays one channel on the two drivers of the first portable speaker system, and passes the other channel to the second portable speaker system for playback on its two drivers.

In accordance with another embodiment, the portable speaker system contains a circuit to automatically detect when a sub-woofer is connected to its output port. When a sub-woofer is detected, the portable speaker system is configured to alter its equalization curve to optimize the sound generated by the sub-woofer and portable speaker system drivers respectively. In other words, when the portable speaker system is played without a sub-woofer, the portable speaker system will adjust its equalization curve to optimize the sound without the sub-woofer.

In each case, to prepare the unit for transport or storage, the user unplugs all connections and presses the ends of the device inward. The support leg automatically folds and retracts into its stored position. Hence, the unit provides compactness in a retracted position for transport or storage yet provides an extended frequency response and an improved channel separation when in the extended configuration.

Accordingly, a portable powered speaker system consisting of at least two drivers and an audio amplifier is provided in a rigid, lightweight, telescoping enclosure, with an auto-extending support leg, battery pack, power input, audio input, and daisy-chain/sub-woofer speaker output. By providing a telescoping enclosure, the channel separation is increased for playback while compactness in transit is preserved. The scope of the invention is intended to extend to telescoping units with at least two drivers in a package either with or without associated power packs and amplification units. For example, the portable speaker system may be provided as a standalone unit (without power or amplification unit) or alternatively packaged with a built in an audio source such as radio, CD, or MP3 player and/or with a built in amplifier. For example, a boom-box type portable speaker system may be provided by integrating the telescoping enclosure with a built in amplification unit, power means, and at least one integrated audio source, such as for non-limiting examples, a radio or MP3 player as well as input/output jacks for connecting other audio sources. In a preferred embodiment, the portable speaker system is provided with drivers, a telescoping enclosure, power means, and an amplifier unit for use with an external audio signal source.

In further summary, in several embodiments, the portable speaker system also contains electronics to sense the presence of an external audio source device, a second portable speaker system, and/or sub-woofer.

The foregoing description describes several embodiments of a portable speaker system. Although the illustrative embodiments describe the telescoping enclosure having two drivers, one for each channel, the invention is not so limited. The scope of the invention is intended to extend to enclosures having a plurality of drivers for each channel. For example, conventional practice includes in some circumstances several drivers in an enclosure, each having responsibility for sound reproduction in a selected portion of the audible sound spectrum. The present invention is intended to cover these and other embodiments wherein a plurality of drivers are used for each channel. By configuring the portable speaker system in accordance with the embodiments described, a high quality audio experience can be added to a portable electronic device such as a laptop computer or portable media player.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A portable speaker system comprising:

a first and second driver; and a telescoping enclosure having an inner section configured to nest within an outer section and to telescope along a longitudinal axis of the enclosure, the first driver coupled to the inner section and the second driver coupled to the outer section, wherein the first and second drivers are oriented such that their primary sound generation direction is substantially perpendicular to the longitudinal axis.

2. The portable speaker system as recited in claim 1, wherein the telescoping enclosure is configurable in at least a closed position and an extended position along the longitudinal axis.

3. The portable speaker system as recited in claim 2, wherein a separation distance between primary axes for the first and second drivers is at least 2 inches greater in the extended position relative to the closed position.

4. The portable speaker system as recited in claim 2 wherein a separation distance between primary axes for the first and second drivers is 4 to 6 inches greater in the extended position relative to the closed position.

5. The portable speaker system as recited in claim 2, wherein a separation distance between primary axes for the first and second drivers is at least 6 inches greater in the extended position relative to the closed position.

6. The portable speaker system as recited in claim 2, wherein the internal volume of the enclosure in the closed position is less than or equal to about 60% of the internal volume of the telescoping enclosure in the extended position.

7. The portable speaker system as recited in claim 2 further comprising a support leg.

8. The portable speaker system as recited in claim 7 wherein the support leg is configured to expand from a folded position to an open position when the telescoping enclosure is moved towards the extended position.

9. The portable speaker system as recited in claim 7 wherein the support leg is configured to automatically open when the telescoping enclosure is extended.

10. The portable speaker system as recited in claim 7 wherein the support leg is configured to automatically close upon retraction of the telescoping enclosure.

11. The portable speaker system as recited in claim 1, wherein the telescoping enclosure comprises a wall having at least an outer shell, an inner shell, and a damping material sandwiched between the outer shell and the inner shell.

12. The portable speaker system as recited in claim 11, wherein outer shell comprises aluminum, the inner shell comprises a plastic material, and the damping material comprises polyethylene foam.

13. The portable speaker system as recited in claim 1 wherein the telescoping enclosure is maintainable in each of a closed and an extended position by a detent coupled to the telescoping enclosure.

14. The portable speaker system as recited in claim 1 wherein the telescoping enclosure has a relatively flat profile with a height to width ratio greater than 2.

15. The portable speaker system as recited in claim 2 wherein the inner section further comprises an amplification unit and controls for the amplification unit and wherein in the closed position, the outer section conceals the amplification unit's access controls.

16. The portable speaker system as recited in claim 1 further comprising an amplification unit for providing an amplified signal to the first and second drivers from an audio signal source.

17. A portable speaker system comprising:

a telescoping enclosure configured to telescope along a first axis; and at least two drivers coupled to the telescoping enclosure and having a variable separation distance between their respective primary axes, wherein the primary axes of the at least two drivers are oriented within 45 degrees of perpendicular to the first axis.

18. The portable speaker system as recited in claim 17 wherein the telescoping enclosure is movable along the first axis to at least a retracted position and an extended position and wherein a separation distance between the primary axes of the drivers corresponds to movement along the first axis of a first section of the telescoping enclosure relative to a second section of the telescoping enclosure.

19. The portable speaker system as recited in claim 18 wherein the first and second section are each associated with at least one of the at least two drivers and in the extended position the first section and second section combine to form a common enclosure having no internal baffle separating the at least two drivers.

20. The portable speaker system as recited in claim 18 wherein in the extended position the first section and second section provide separate enclosure volumes, at least one driver associated with each of the separate enclosure volumes.

* * * * *